US006056572A

United States Patent [19]

Matsumoto et al.

[11] Patent Number: 6,056,572

[45] Date of Patent: May 2, 2000

[54] CONNECTOR FOR PRINTED CIRCUIT BOARDS

[75] Inventors: Haruhiko Matsumoto; Nobuhito Ebine; Toshikazu Sekiguchi, all of Kanagawa, Japan

[73] Assignees: Japan Solderless Terminal Manufacturing Co., Ltd., Osaka; Sony Corporation, Tokyo, both of Japan

[21] Appl. No.: 09/166,129

[22] Filed: Oct. 5, 1998

[30] Foreign Application Priority Data

Dec. 24, 1997 [JP] Japan ..... 9-366999

[51] Int. Cl.[7] ..... H01R 13/15

[52] U.S. Cl. ..... 439/260; 439/495

[58] Field of Search ..... 439/260, 495, 439/492, 493, 259, 329, 67, 77, 630, 341

[56] References Cited

U.S. PATENT DOCUMENTS 5,842,883 12/1998 Igarashi et al. ..... 439/495

5,904,586 5/1999 Takayasu ..... 439/260

*Primary Examiner*—Neil Abrams

*Assistant Examiner*—Eugene G. Byrd

*Attorney, Agent, or Firm*—Antonelli, Terry, Stout & Kraus, LLP

[57] ABSTRACT

A connector for printed circuit boards, particularly for flexible ones such as FPC or FFC, has an insulating housing (2) with a recess (7) opened up and base contacts (3) held in the housing at regular intervals and each having a resilient beam (14) and an arm (5) integral with the beam. Each beam has a conductive protrusion (17) in the recess, and each arm extending along the housing's top into the recess has a pivotal end (18) facing the protrusion. An insulated pressing cover (4) engaging with the pivotal ends is rotatable between its pressing position adjacent to and its releasing position remote from the protrusions. The pivotal ends (18) lock the cover then pushing the circuit board (30) against the resilient beams (14). The cover has cover contacts (20) rotatably engaging with the pivotal ends and corresponding to the base contacts (3), so that the pivotal ends, the cover contacts (20) and the printed circuit board (30) are electrically connected to each other at the pressing position.

9 Claims, 8 Drawing Sheets

CONNECTOR FOR PRINTED CIRCUIT BOARDS

BACKGROUND OF THE INVENTION

1. Field of the Invention

The present invention relates to a connector adapted for attachment to flexible printed circuit boards such as the so-called flexible printed cables ("FPC") or flexible flat cables ("FFC") that have to be electrically connected to electric or electronic devices or apparatuses.

2. Prior Art

An example of those connectors known in the art and designed for use with flexible printed circuit boards is disclosed in the Japanese Laying-Open Gazette of Unexamined Utility Model No. 6-77186. As shown in FIGS. 12 and 13 accompanying the present specification, such a prior art connector comprises an insulating housing 41 having a horizontal top wall 42 whose front portion is cut off to provide an accessible opening or space 43 opened forward and upward. A plurality of conductive contacts 45 are installed in the housing 41 at regular intervals and in a direction perpendicular to the drawing figures. Each contact 45 has a resilient beam 47 U-shaped in cross section and extending from the contact's body 46 and in parallel with a bottom 44 of the insulating housing. The body 46 is fitted in a rear opening of the housing 41. A conductive protrusion 48 integral with and jutting from a free end of the resilient beam 47 serves as a contact point exposed in the accessible space 43. Each contact 45 has an arm 49 extending from the body 46 in parallel with the horizontal top 42 of the housing. The arm 49 has a generally round free end facing the space 43 and serving as a pivot 50. On the other hand, an insulated pressing cover 51 disposed in the space 43 is rotatable about the pivots 50. This pressing cover 51 is capable of swinging between its closed pressing position adjacent to the protrusions 48 and its opened releasing position remote therefrom. Each curved recess 52 of the cover 51 is of an arcuate cross section fitting on and slidingly engaging with the pivot 50, and the cover further has bulged portions 53. With the insulated pressing cover 51 having swung to the pressing position, each bulged portion 53 will press against a flexible printed circuit board 30 laid on the resilient beam 47. Thus, a conductive circuit pattern 31 formed on that flexible board 30 will electrically engage with the conductive protrusion 48 of each contact 45.

Those metal pivots 50 of the contacts 45 looks like comb's teeth and may be regarded as functioning as discontinuous segments of a rigid and strong metal shaft, in the prior art connector for flexible printed circuit boards. The pressing cover 51, whose curved recesses 52 are held in position by and rotatable about the metal pivots 50, is however made of a plastics less rigid and much weaker than those pivots. Due to their repeated swing to the pressing position, those recesses 52 formed of the plastics are likely to undergo deformation such that the cover's force of pressing the flexible printed circuit boards would be lowered or become uneven or less reliable.

Further, each flexible board 30 must lie with its face down when inserted into the connector so that its conductive circuit pattern 31 comes into contact with the resilient beam 47. This cumberxome requirement has been another problem in handling and/or using the prior art connectors of the described type.

SUMMARY OF THE INVENTION

The present invention was made to resolve those problems in the prior art. Therefore, it is an object of the present invention to provide a connector generally for use with flexible printed circuit boards and having a pressing cover improved in strength and capable of being pressed against said circuit boards always in a reliable manner. Another object of the present invention is to provide a connector designed such that any circuit board can be coupled with it whether a printed pattern thereof may face up or down. A still further object is to provide such a connector that can not only be used with the flexible circuit boards but also with rigid non-flexible ones.

In order to achieve the objects, the connector provided herein for use with a printed circuit board or boards comprises an insulating housing having a recess opened upward and a top horizontal wall, a plurality of base contacts secured in the housing at regular intervals and each having a resilient beam and a contact arm formed integral therewith, a conductive protrusion of each resilient beam being disposed in the recess, the contact arms extending along the top horizontal wall into the recess and having at their ends retaining portions facing the respective conductive protrusions, and an insulated pressing cover engageable with the retaining portions and shiftable between a pressing position adjacent to the conductive protrusions and a releasing position remote therefrom. The retaining portions of the base contacts are intended to firmly lock the pressing cover at its pressing position to push the printed circuit board or boards against the resilient beams. The pressing cover has on its inner side a plurality of cover contacts corresponding to the base contacts so that the retaining portions, the cover contacts and the printed circuit board or boards are electrically connected to each other at the pressing position.

It is a highly advantageous feature of the present invention that as the cover takes its pressing position, the cove contacts carried thereon will strongly be pressed against and forced into sure and reliable electric contact with the retaining portions of the base contacts. In one of important modifications of the invention, the retaining portions of the base contacts are rendered rockable up and down a small angle. The cover contacts in this case will urge the retaining portions upwards when the cover is shifted to its pressing position, thereby enhancing reliability in electric conduction. In another modification, each base contact has a mediate stopper integral therewith and located between its arm and its resilient beam. This mediate stopper will abut against the cover contact at the pressing position, affording surer conduction between each cover contact and the corresponding base contact.

THE PREFERRED EMBODIMENTS

Figure 1:
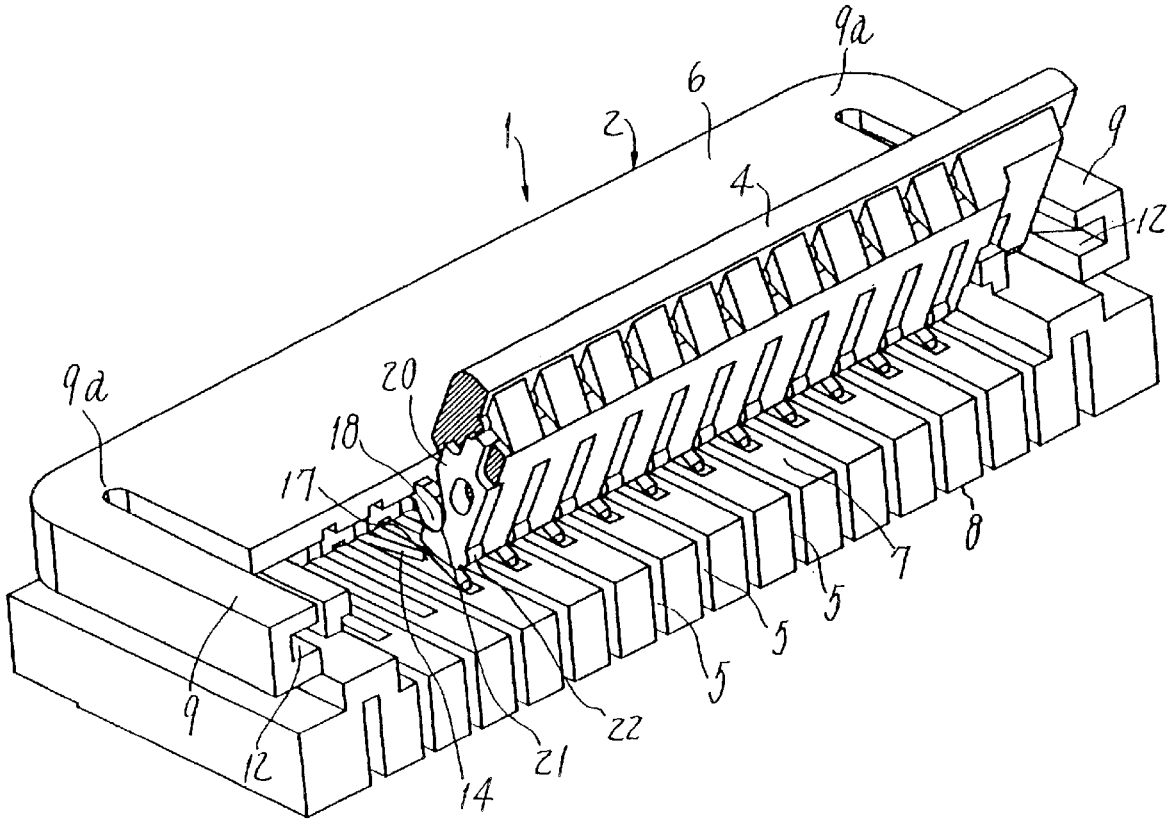
FIG. 1 is a perspective view of a connector in an embodiment of the invention for use with printed circuit boards, the connector having a pressing cover shown in its swinging state and partly cut off.

Some preferable embodiments of the present invention will now be described in detail referring to the drawings.

Figure 2:
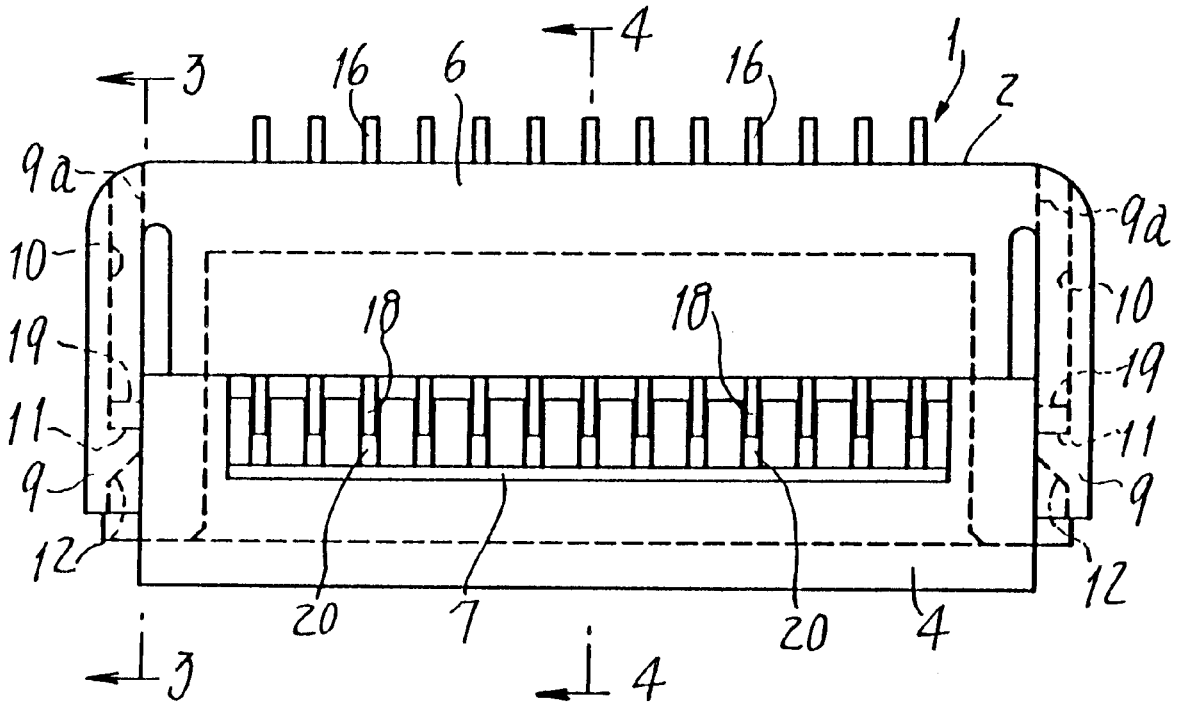
FIG. 2 is a plan view of the connector of FIG. 1.

In an embodiment of the present invention, a connector as shown in FIGS. 1 and 2 is provided for use with printed circuit boards. Similarly to the prior art connectors as summarized above and known in the art, the connector 1 comprises an insulating housing 2, a plurality of base contacts 3 (see FIG. 4) secured in the housing at regular intervals, and an insulated pressing cover 4 swingably attached to the hosing 2.

Figure 3:
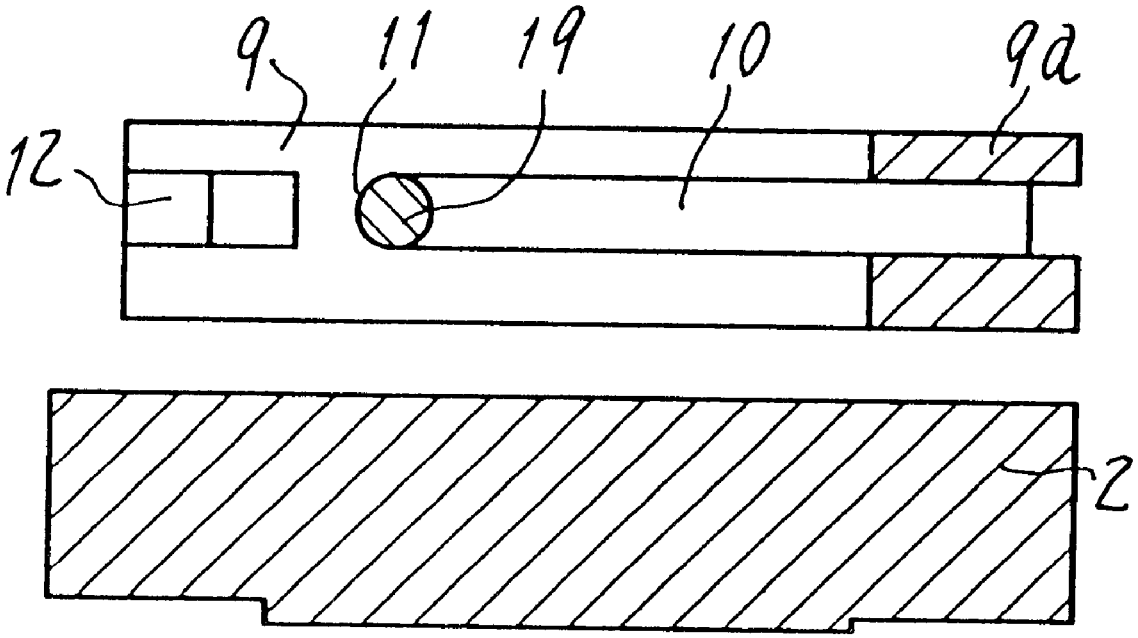
FIG. 3 is a cross section taken along the line 3—3 in FIG. 2.

The housing 2 made of an appropriate insulating material such as LCP is of a flat rectangular parallel-piped shape extended in a longitudinal direction ('sideways' in the drawings). Contact receiving grooves 5 formed in the housing at regular intervals extend fore to aft and perpendicular to the longitudinal direction. A top horizontal wall 6 of the housing has an imaginary frontal region cut off to provide an open recess 7 opened upward. A pair of arm-shaped holders 9 are disposed at longitudinal ends of the housing so as to hold the ends of the pressing cover 4. Each arm-shaped holder 9 has a basal end 9*a* integral with a rear end of a side portion of the housing 2, so that the arm protrudes along the side portion to the front face of the connector. Thus, the arm-shaped holders 9 are elastically deformable about their basal ends 9*a*. As seen in FIGS. 2 and 3, a side retention groove 10 formed in the inner side of each arm-shaped holder 9 extends over a halfway from the basal end 9*a* and terminates remotely from the front face of the connector. A semicircular bearing end 11 is disposed at the inner end of each side retention groove 10. Guide grooves 12 also formed in the arm-shaped holders 9 extend backward from the front face and terminate short of the semicircular bearing ends 11.

Figure 4:
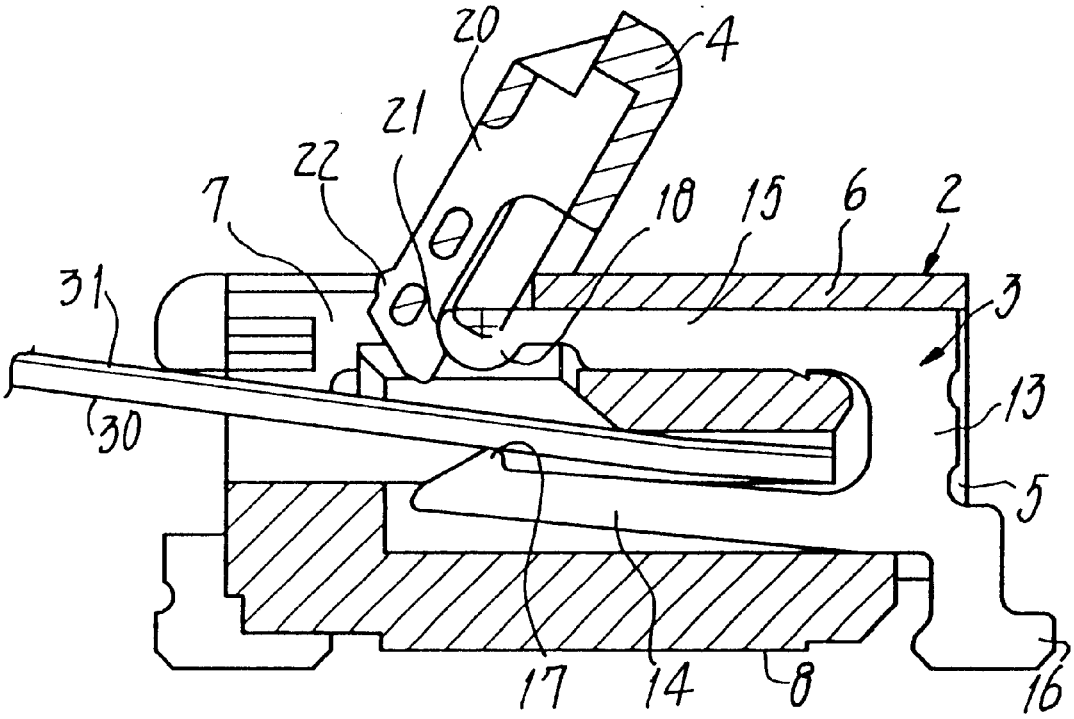
FIG. 4 is a cross section taken along the line 4—4 in FIG. 2, wherein the pressing cover is open to receive a flexible printed circuit board being inserted.

The base contacts 3 are made by punching a thin copper alloy plate or sheet. As best seen in FIG. 4, each base contact 3 comprises a short body 13 fitted in the rear opening of the contact receiving grooves 5. A resilient contact beam 14 continuing from the short body 13 extends along a bottom 8 of the housing 2 forward and slightly upward. The resilient beam 14 can thus elastically deform itself up and down relative to the short body 13 serving as a fulcrum. A contact arm 15 continuing from the short body 13 and lying in parallel with the inner side of the top horizontal wall 6 terminates in the open recess 7. Each of the base contacts 3 further has a lead 16 protruding down and backward from the short body 13. A conductive protrusion 17 formed integral with and jutting from a free end of the resilient beam 14 is exposed in the open recess 7. A rounded end of the contact arm 15 is a retaining portion 18 shaped and functioning as a pivotal end in this embodiment. This retaining portion 18 facing the conductive protrusion 17 and partly exposed in the recess 7 is inhibited by the top wall 6 from making any upward displacement. Thus, the contact arm 5 itself will stand still in the housing 2 together with such a retaining portion 18. Those retaining portions 18 are arranged side by side in said housing 2, as if they were teeth of a comb. From another point of view, they may be regarded as intermittent sections of a transverse shaft whose axis coincides with that of the semicircular inner ends 11 of the arm-shaped holders 9.

The pressing cover 4 is made of an insulating material such as a Nylon (a registered trademark). Short studs 19 protruding sideways from the lateral sides of this pressing cover 4 (see FIGS. 2 and 3) are intended to be supported in and by the semicircular bearing ends 11 that are formed in the arm-shaped holders 9. A series of cover contacts 20 are disposed in the cover, side by side corresponding to the base contacts 3, and at the same pitch as the latter. Those cover contacts 20, that are likewise made by punching a thin copper alloy sheet and placing them as the so-called 'inserts' in a mold such as an injection mold when forming the pressing cover 4 therein, are therefore integral therewith. An arcuate cutout 21 is formed in an upper side of each cover contact's rear end. Those cutouts 21 are brought into and kept in a sliding and rotating contact with the retaining portions 18. A small lug 22 protruding from a lower side of each cover contact serves as a pressing point. Similarly to the retaining portions 18 of the base contacts 3, the arcuate cutouts 21 are arranged in a comb teeth pattern relative to the pressing cover 4. Centers of such curved cutouts 21 extend co-axially with the short studs 19.

To assemble the connector, the short studs 19 will be forced at first strongly into the guide grooves 12 of the arm-shaped holders 9 of housing 2. As a result, the holders 9 will be elastically expanded a little outwardly away from each other until those studs 19 snap in the semicircular bearing ends 11 so as to be rotatable therein. Consequently, the arcuate cutouts 21 of the cover contacts 20 will come into engagement with the retaining portions 18, thereby bringing the pressing cover 4 into a rotating contact with the housing 2. Thus, the cover contacts are rendered swingable between their pressing position located near the conductive protrusions 17 of the resilient beams 14 and their open position located remote therefrom. With the cover 2 being swung to its position where the cover contacts 20 take their pressing position, the small lug 22 protruding from each cover contact will serves as a point pressed against a flexible printed circuit board 30 (such as the 'FPC' or 'FFC' as referred to above) laid on each resilient beam 14. In this state of these members, each arcuate cut-out 21 is urged into a forced contact with the corresponding retaining portion 18 of the contact arm, thereby establishing reliably and without failure electrical conduction between them and thus between each of the cover contacts 20 and the corresponding base contact 3. It is a matter of course that the size and shape of those cutouts 21 and the small lugs 22 (serving as the contact points) are designed to ensure these effects and functions as just discussed above.

The connector of the described structure will be used in the following manner.

Figure 5:
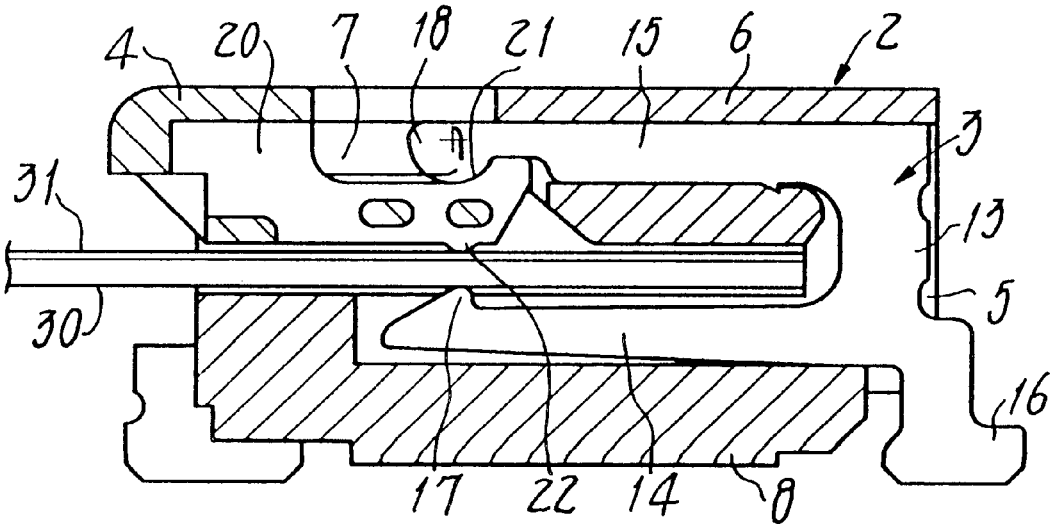
FIG. 5 is also a cross section corresponding to FIG. 4, but with the cover shown at its pressing position.

It will be a first step to swing the pressing cover 4 (see FIG. 4) up and away from the housing 2 to take its open position where the frontal end and the recess 7 of the housing are opened wide. Next, flexible printed circuit board or boards 30 will be inserted through the recesses 7 so as to lie on the resilient beams 14. The conductive pattern 31 formed on the circuit boards may face up or down, although it faces up in the illustrated example. Then, the pressing cover 4 will be rotated downward to take a pressing position shown in FIG. 5. At this pressing position, the small lugs 22 of the cover contacts 20 will press the printed circuit boards 30 against the resilient beams 14, while being brought into electrical connection with the conductive patterns 31 of said boards. Simultaneously, the arcuate cutouts 21 of the cover contacts 20 will have been pressed against the retaining portions 18 of the contact arms so as come into electrical connection therewith. As a result, the printed conductive patterns 31 on those boards 30 are brought into electrical connection with the respective base contacts 3, through the respective cover contacts 20. Alternatively, the circuit boards 30 may be reversed up-side down causing their conductive patterns 31 to face the resilient beams when inserted into this connector. In this case, those patterns will directly be pressed against the conductive protrusions 17 of said beams 14, likewise establishing electrical connection between said patterns and the base contacts 3.

Figure 6:
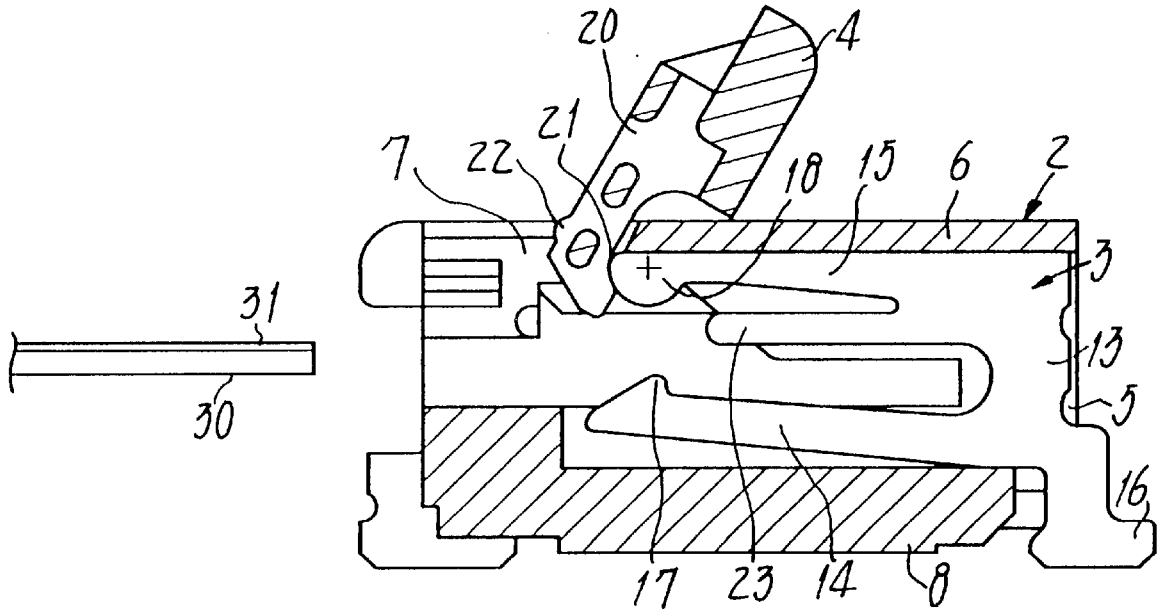
FIG. 6 is a cross section of the connector in another embodiment, with its pressing cover opened to receive a flexible printed circuit board.
Figure 7:
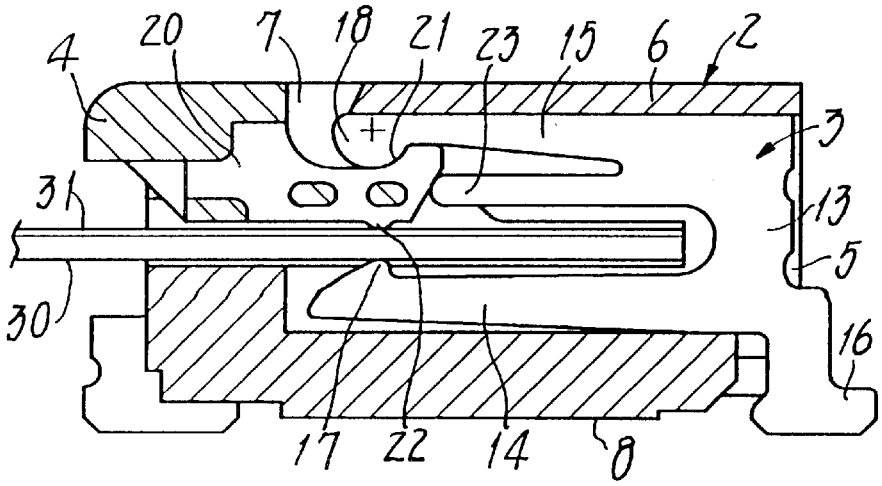
FIG. 7 is also a cross section corresponding to FIG. 6, but with the cover shown at its pressing position.

FIGS. 6 and 7 show another embodiment wherein each of the base contacts 3 has a mediate stopper 23 formed integral therewith. When the cover 4 takes its pressing position as shown in FIG. 7, this stopper 23 will abut against the inner end of cover contact 20 so that surer conduction is afforded between each base contact 3 and the corresponding cover contact 20.

Figure 8:
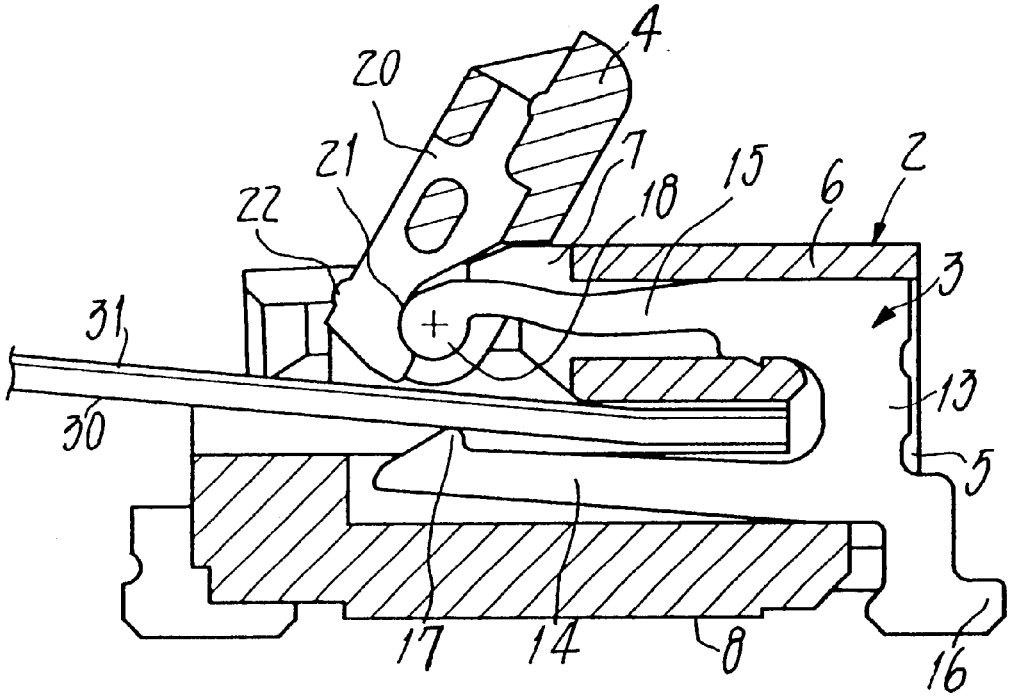
FIG. 8 is a cross section of the connector in a further embodiment, with its pressing cover similarly opened to receive a flexible printed circuit board.
Figure 9:
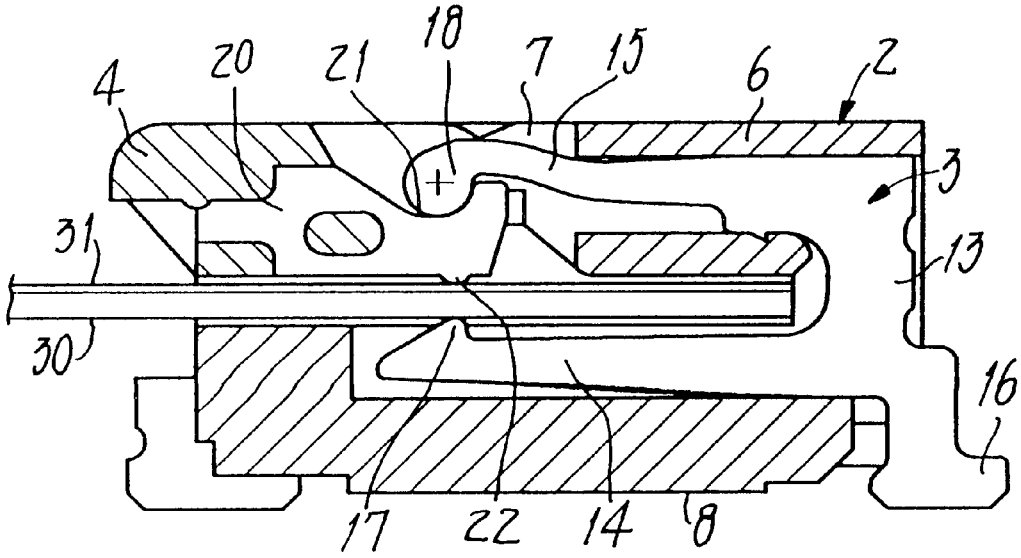
FIG. 9 is also a cross section corresponding to FIG. 8, but with the cover shown at its pressing position.

FIGS. 8 and 9 show a further embodiment that will also contribute to surer conduction between the base contact 3 and the cover contact 20 shifted to the pressing position. The contact arm 15 of each base contact 3 in this embodiment extends to a middle region of the open recess 7 and is rendered somewhat flexible. Such an elongated arm 15 has thus its retaining portion 18 rockable up and down a small angle. Therefore, as the cover 4 swings to its pressing position, the cover contact 20 will urge upwards the pivotal end 18 so as to firmly contact same. Since this retaining portion 18 tending to restore its normal position imparts a downward stress to the base contact's arcuate cutout 21, much surer conduction will be afforded between the mating contacts 3 and 20. The retaining portion's upward displacement caused by the cover contact 20 will force in turn the short studs 19 functioning as the shaft for the pressing cover 4 to also rock upward. Thanks to elasticity of the arm-shaped holders 9 of the housing 2, the cover 4 will not encounter any strong resistance while shifting to its pressing position. It may be possible to provide the housing 2 with such short studs 19 to be in mesh with arm-shaped elastic holders 9 formed on the cover 4.

Figure 10:
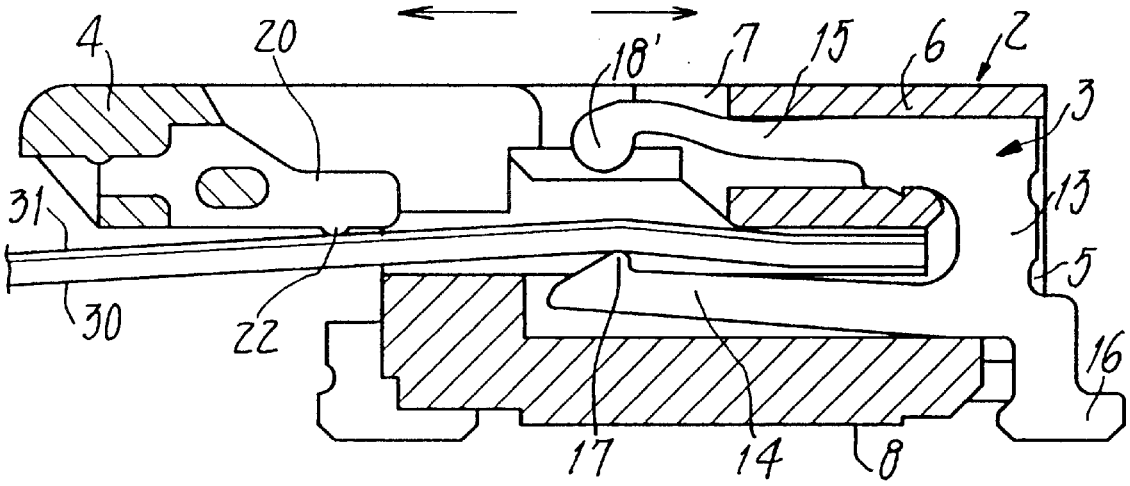
FIG. 10 is a cross section of the connector in a still further embodiment, wherein its pressing cover is rendered slidable relative to the connector's body and shown in an opened state for accommodation of a flexible printed circuit board.
Figure 11:
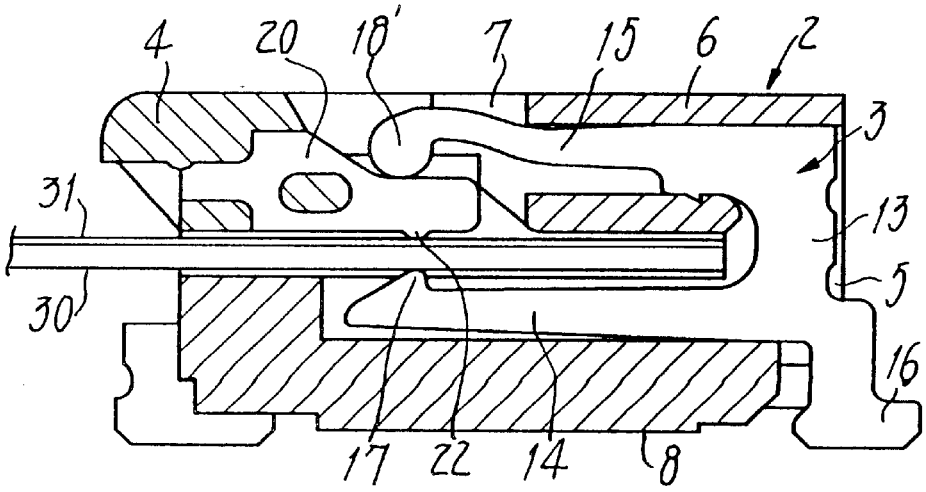
FIG. 11 is also a cross section corresponding to FIG. 10, but with the cover shown at its pressing position.
Figure 12:
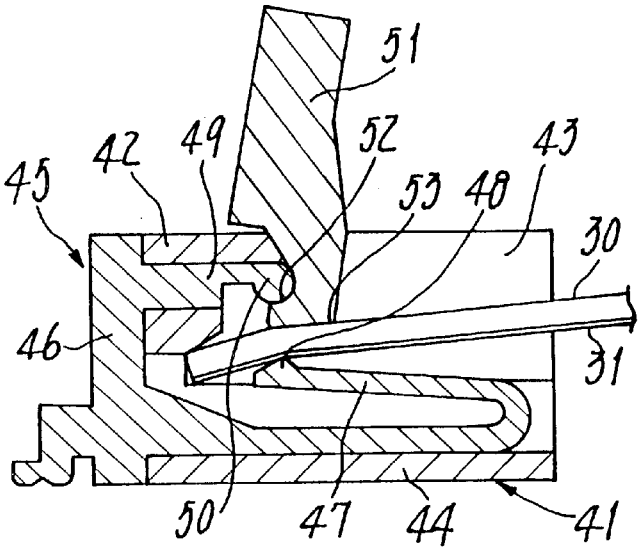
Fig.12 (PRIOR ART)
FIG. 12 is a cross section of one of the prior art connectors, shown with its pressing cover opened to receive a flexible printed circuit board being inserted.
Figure 13:
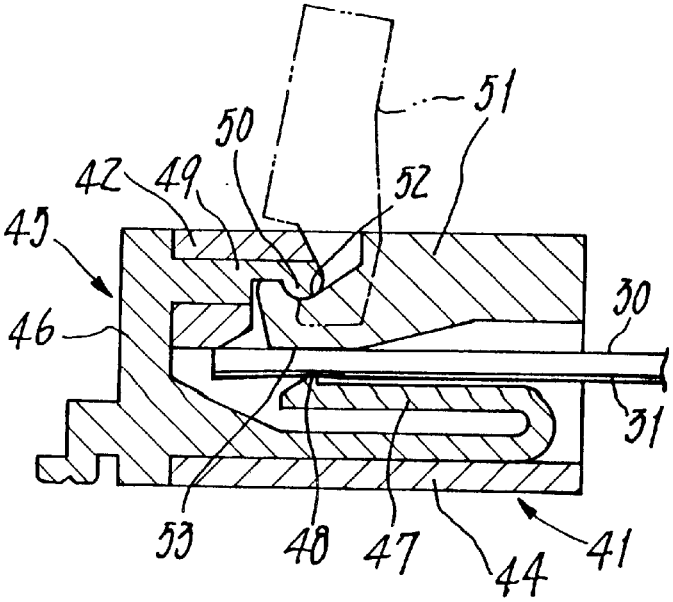
Fig.13 (PRIOR ART)
FIG. 13 is also a cross section corresponding to FIG. 12, with the cover shown at its pressing position.

FIGS. 10 and 11 show a still further embodiment similar to that shown in FIG. 8. However, the pressing cover 4 in this connector is intended to slide straightly towards and away from the housing 2, as indicated at the arrows. In this case, the retaining portion 18' (not necessarily functioning as a pivotal end) will be urged up by the cover contact 20 as the cover 4 forcibly moves from its open position shown in FIG. 10 to its pressing position shown in FIG. 11. Sure electric connection will also be produced between the mating retaining portion 18' and cover contact 20. A mediate stopper 23 as illustrated in FIG. 6 may protrude from the base contact 3 in this embodiment too, in order to ensure reliable conduction between it and the cover contact 20 mating therewith.

Although the above embodiments have been described above in relation to the flexible printed circuit boards, the connector of the present invention can of course be used for electrical connection of ordinary rigid printed circuit boards.

The connector provided herein and described above is advantageous in that any printed circuit boards can be connected thereto whether their printed conductive patterns do face up or down.

In summary, the pressing cover has cover contacts made of a metal sheet and engaging with the retaining portions (functioning in most cases as pivotal ends) of the base contacts also made of the same or another metal sheet. Therefore, the pressing cover reinforced with those metallic cover contacts can now be urged into much stronger and more stable mechanical engagement with the metallic base contacts, thereby producing reliable electrical connection of the base contacts with the printed circuit boards.

What we claim is:

1. A connector for printed circuit boards, the connector comprising:

an insulating housing having a recess opened upward and a top horizontal wall;

a plurality of base contacts secured in the housing at regular intervals and each having a resilient beam and a contact arm formed integral therewith;

each resilient beam having a conductive protrusion disposed in the recess, and each contact arm extending along the top horizontal wall into the recess and having a retaining portion facing the conductive protrusion;

an insulated pressing cover engageable with the retaining portions and shiftable between a pressing position adjacent to the conductive protrusions and an releasing open position remote therefrom;

the retaining portions capable of locking the pressing cover at its pressing position to push the printed circuit board or boards against the resilient beams; and a plurality of cover contacts disposed in the pressing cover and corresponding to the base contacts, so that the retaining portions, the cover contacts and the printed circuit board or boards are electrically connected to each other at the pressing position.

2. A connector as defined in claim 1, wherein as the cover takes its pressing position, the cover contacts carried thereon are strongly pressed against the retaining portions.

3. A connector as defined in claim 1 or 2, wherein the retaining portions of the base contacts are rockable up and down so that the cover contacts urge the retaining portions upwards when the cover is shifted to its pressing position.

4. A connector as defined in claim 3, wherein each of the base contacts further has a mediate stopper integral therewith so as to abut against the cover contact at the pressing position.

5. A connector as defined in claim 3, wherein the pressing cover is rotatable about the retaining portions.

6. A connector as defined in claim 4, wherein the pressing cover is rotatable about the retaining portions.

7. A connector as defined in claim 5, wherein the housing has elastic and arm-shaped holders for rotatably supporting the pressing cover.

8. A connector as defined in claim 3, wherein the cover is capable of sliding towards and away from the retaining portions so as to engage therewith or disengage therefrom.

9. A connector as defined in claim 4, wherein the cover is capable of sliding towards and away from the retaining portions so as to engage therewith or disengage therefrom.

* * * * *